United States Patent [19]

Van Brunt

[11] Patent Number: 4,468,080

[45] Date of Patent: Aug. 28, 1984

[54] CABLE SHIELD TERMINATION MEANS FOR PLUG AND RECEPTACLE CONNECTORS

[75] Inventor: Michael K. Van Brunt, Santa Monica, Calif.

[73] Assignee: Automation Industries, Inc., Greenwich, Conn.

[21] Appl. No.: 275,934

[22] Filed: Jun. 22, 1981

[51] Int. Cl.[3] ..... H01R 13/46; H01R 13/648

[52] U.S. Cl. ..... 339/136 R; 174/35 C; 174/75 C; 339/177 E

[58] Field of Search ..... 174/35 C, 75 C, 88 C, 174/89; 339/136 R, 136 C, 142, 143 R

[56] References Cited

U.S. PATENT DOCUMENTS

| | | | |
|---|---|---|---|
| 3,104,145 | 9/1963 | Somerset | 174/75 C |
| 3,622,952 | 11/1971 | Hilbert | 174/89 |
| 4,156,554 | 5/1979 | Aujla | 174/89 |
| 4,382,653 | 5/1983 | Blanchard | 339/143 R |

FOREIGN PATENT DOCUMENTS

| | | | |
|---|---|---|---|
| 1237644 | 6/1960 | France | 174/89 |

*Primary Examiner*—J. V. Truhe
*Assistant Examiner*—Morris H. Nimmo
*Attorney, Agent, or Firm*—Francis N. Carten

[57] ABSTRACT

For cable termination, a metal plate is fit into the open cable-receiving end of either a connector plug or receptacle. One or more openings in the plate include hollow metal tubes conductively secured to the plate. A set of cable wires within a grounded shield have a shield end portion peeled back preliminary to the wires being passed through one of the tubes and connected to an appropriate connector contact. The peeled-back shield end portion extends over the tube. A ring of solder about the shield affixes it to the tube. Optionally, an aluminum ring may be clamped over the shield sleeve by an electric current operated cryo ring. In another shield connection technique, an oversized ferrule is crimped onto the shield. An elongated tapered cylindrical adapter has one end of a diameter enabling fitting receipt onto the connector open end and a recessed shoulder for engaging edge portions of the connection plate to secure it in place.

3 Claims, 3 Drawing Figures

CABLE SHIELD TERMINATION MEANS FOR PLUG AND RECEPTACLE CONNECTORS

The present invention relates generally to plug and receptacle electrical connectors and, more particularly, to means for providing a cable shield termination at the connector to prevent radio frequency and electromagnetic pollution.

BACKGROUND

A well-known highly successful form of electrical connector has plug and receptable parts which can be joined together to interconnect a plurality of cable wires via mating pins and sockets in the respective parts. The cable wires typically have a shield for grounding at both cable ends to prevent electromagnetic and radio frequency interference from outside sources, with adjacent elective equipment and cross-interference with other cable wires.

SUMMARY OF THE INVENTION

The cable termination means of this invention includes a metal plate which can be fit into the open cable-receiving end of a connector plug or receptacle. The plate has a plurality of openings into which one or more hollow metal tubes are received and conductively secured to the plate. One or more insulated cable wires are located within a grounded sheath or shield, an end portion of which is peeled back preliminary to the insulated wire/s being passed through one of the tubes and connected to the appropriate connector contact, either pin or socket contact as the case may be. Other cable wires within a grounded shield may be passed through other tubes, as needed.

The peeled-back end portion of each shield is unfolded as a sleeve over the outer end portion of the tube. A ring of solder may be used to affix the shield and tube together, both mechanically and electrically. Optionally, an aluminum ring may be clamped over the shield sleeve by a so-called cryo ring through which an electric current is passed. As a still further shield connection technique, an oversized ferrule was crimped by the use of a suitable tool down onto the shield.

An elongated tapered cylindrical adapter has one end of a diameter enabling fitting receipt onto the connector open end, a recessed shoulder for engaging edge portions of the connection plate to secure it in place. When so positioned the adapter is secured to the connector part.

DESCRIPTION OF PREFERRED EMBODIMENTS

Figure 1:
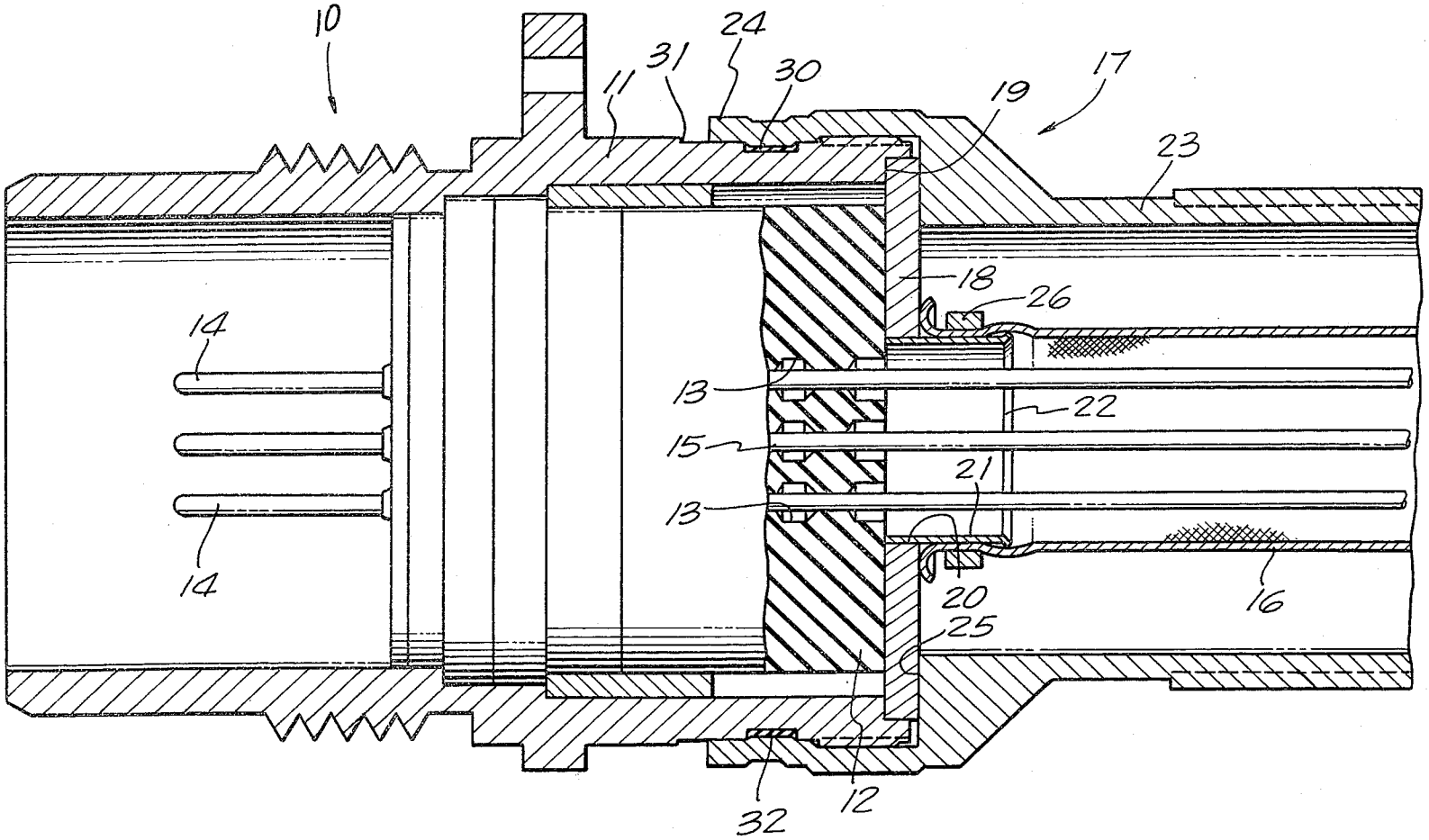
FIG. 1 is a sectional, elevational view through a connector part end and cable shield termination means of the invention.

With reference now to the drawing and particularly FIG. 1, an electric connector part with which the present invention is most advantageously used, is identified generally as at 10. It is seen to include a hollow, generally cylindrical metal connector shell 11 within the bore of which is located an insulative rubber or plastic insert 12. A plurality of openings 13 in the insert extend parallel to the shell cylindrical axis and include connector pin contacts 14 (or socket contacts, as the case may be) to which cable wires 15 are secured (e.g., by crimping). The complete connector has two parts, a plug and a receptacle, which are quickly and releasably joined together to effect connection between the various paired sets of cable wires. The connector shell 11 is conventionally constructed of high-quality aluminum plated with a suitable fusible metal or alloy to prevent undesirable oxidation and corrosion.

Each cable wire 15 typically includes one or more conductors encapsulated within an insulative material. Preferably a plurality of cable wires 15 are contained within an outer braided metallic shield or sheath 16.

The shield 16 electrically and magnetically isolates the enclosed cable wires 15 from external equipment and influences. That is, external equipment is isolated by the shield from any radio frequency or electromagnetic interference that may be generated at the enclosed cable wires. In turn, the shield acts to prevent the enclosed cable wires from being actively influenced by externally located sources of electromagnetic interference, radio frequency interference, and electromagnetic pulse interference (i.e., from a nuclear explosion). To be effective the shield must be securely affixed to the connector part 10.

With reference now specifically to FIG. 1, the shield termination means identified generally by the numeral 17 is seen to include a circular plate 18 which fits into and covers the connector part shell 11 end. More particularly, the inner open end wall of connector shell 11 is removed to provide a continuous should 19 against which the plate 18 abuts. When so positioned the outer major surface of plate 18 extends outwardly of the end of shell 11 for a purpose to be described. The plate has a plurality of openings 20 formed therein substantially aligned with certain insert openings 13. Although other materials may be found satisfactory, it is preferred that the plate 18 be constructed of aluminum coated with a suitable corrosion resistant metal or fusible alloy.

A separate hollow metal tube 21 is received within each plate opening 20 and conductively secured to the plate. The inner end of each tube is preferably faced off to be coextensive with the inner major surface of the plate. The outer ends of the tubes extend away from the plate surface a substantial amount and include an enlarged flange 22.

An adapter 23 is a hollow generally cylindrical metal tube having a large diametral end 24 with an internal bore of such dimensions as to enable fitting receipt onto the open end of the connector shell 11. An inner wall 25 forms a shoulder which can abut against the outer surface of plate 18 when assembled. The remainder of the adapter is of smaller diameter and may include an end portion (not shown) threaded for connection with an adapting part, if desired. The adapter has a relatively thick wall to provide the rigidity and overall strength necessary to protect the cable wires during use from breakage or being inadvertently pulled from the connector pin (or socket) contacts.

In assembly of the invention as described to this point, the cable wires 15 have the surrounding end portion of the shield 16 folded back and the insulation covered wires are passed through the tube 21. The insulation is removed from the wire ends and they are connected to the proper connector contacts in openings 13, which is conventionally accomplished by crimping. The plate 18 is pressed into the open end of the shell 11 and secured therein by applying a relatively large magnetic field circumferentially about the shell end which clamps the shell onto the plate edges.

With the plate 18 in place on the connector part, the next step is to connect electrically each of the shields 16 to the respective tubes 21. As shown in FIG. 1, a length of the shield 16 fits as a sleeve over the outer end of the tube 22, and a quantity of a fusible metal 26 in the form of a ring which upon melting extends about the tube securing the shield and tube together both mechanically and electrically. The enlarged flange 22 serves as a mechanical means for retaining the ring 26 and the shield 26 on the tube.

Figure 2:
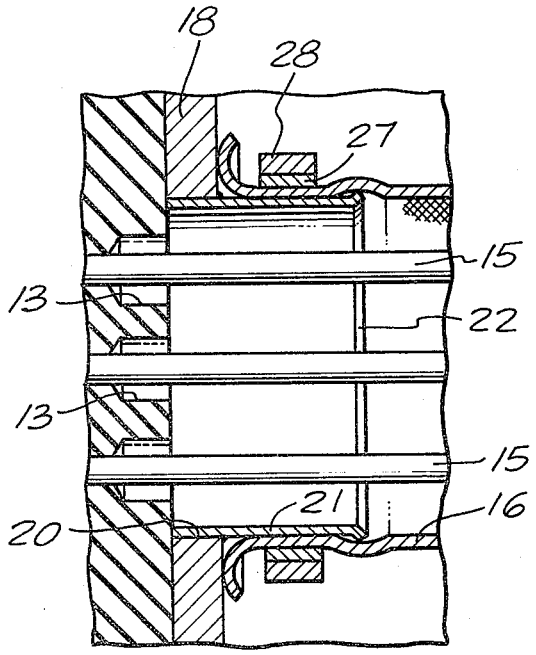
FIG. 2 is an enlarged sectional, partially fragmentary, view of an alternate form of shield connection.

FIG. 2 depicts an alternate technique for interconnecting the shield and tube in which a relatively closely fitting aluminum loop 27 is received over the shield end portion on the tube end. A special ring 28 received over the loop 27 when heated to a prescribed temperature, shrinks and thereby deforms the loop 27 clamping the shield onto the tube end. A satisfactory material from which to make the special shrinking ring 28 is sold under the trade identification "Betalloy" by Raychem Corporation.

Figure 3:
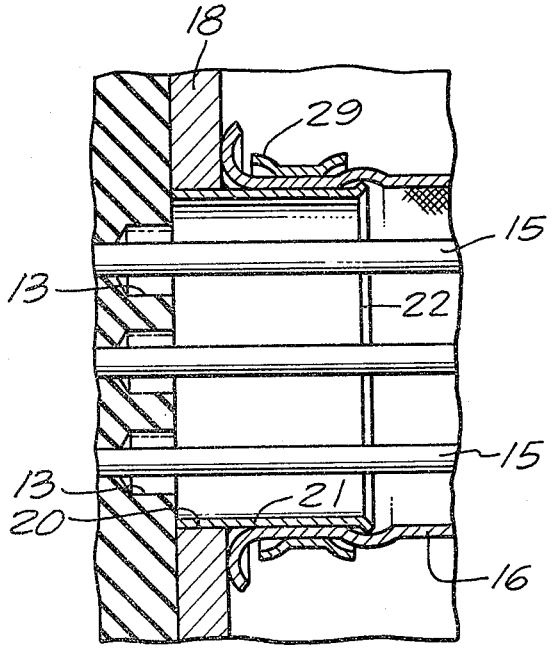
FIG. 3 depicts yet another form of shield connection.

For a still further connection technique, reference is now made to FIG. 3 where it is seen that an oversize ferrule 29 is deformed by a suitable tool to clamp the shield onto the tube.

The final assembly step is the affixation of the adapter 23 onto the open end of the shell 11. A relatively deep circumferential slot 30 lies within a shallower and wider slot 31 in the peripheral marginal surface of shell 11. A rubber or other elastomeric material O-ring 32 is located in the deep slot 30 after which the adapter 23 firmly located on the shell end with the shoulder 25 abutting the plate 18. As a result of the so-called "hoop-stress" phenomenon, when a relatively large magnetic field (e.g., 300,000 Gauss) is applied to adapter large end, this deforms the adapter wall down into the grooves 30 and 31 thereby securing the adapter and shell 11 tightly together. This clamping effect also deforms the O-ring 32 producing a seal therearound against the ingress of dirt, dust and moisture.

I claim:

1. An electrical connector half, comprising in combination:

an outer metal shell with an opening for receiving at least one cable wire with an enclosing shield;

a metal plate located within the shell opening in contact with the shell and having at least one opening therethrough;

a hollow metal tube secured in an opening of said plate for receiving the cable wire therein and to which tube the cable wire shield is electrically connected;

a hollow metal adapter secured to the metal shell over the shell opening and having parts abutting against the plate outwardly directed surface; and said metal shell outer surface adjacent the opening therein being cylindrical and including a first slot extending circumferentially thereabout, said adapter being received onto the cylindrical shell and clamped thereto with parts of the adapter extending into the first slot.

2. An electrical connector half as in claim 1, in which a second circumferential slot in the shell includes an O-ring which is deformed into sealing relation by the adapter being clamped thereover.

3. An electrical connector half as in claim 1, in which there is further provided a ring means for being clamped about a wire shield and a tube by a heat-induced shrinking member received over said ring means.

* * * * *